US010144882B2

(12) United States Patent
Dindi et al.

(10) Patent No.: US 10,144,882 B2
(45) **Date of Patent: *Dec. 4, 2018**

(54) HYDROPROCESSING OF HEAVY HYDROCARBON FEEDS IN LIQUID-FULL REACTORS

(75) Inventors: Hasan Dindi, Wilmington, DE (US); Luis Eduardo Murillo, Wilmington, DE (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 2359 days.

This patent is subject to a terminal disclaimer.

(21) Appl. No.: 12/914,061

(22) Filed: Oct. 28, 2010

(65) Prior Publication Data

US 2012/0103868 A1 May 3, 2012

(51) Int. Cl.
*C10G 49/00* (2006.01)
*C10G 49/04* (2006.01)
*C10G 49/08* (2006.01)

(52) U.S. Cl.
CPC ..... *C10G 49/04* (2013.01); *C10G 49/08* (2013.01); *C10G 2300/802* (2013.01); *C10G 2400/02* (2013.01); *C10G 2400/04* (2013.01)

(58) Field of Classification Search
CPC ..... C10G 45/00; C10G 45/22; C10G 47/26; C10G 49/12; C10G 2300/4081
USPC ..... 208/89
See application file for complete search history.

(56) References Cited

U.S. PATENT DOCUMENTS

| | | | | |
|---|---|---|---|---|
| 3,180,820 | A | 4/1965 | Gleim et al. | |
| 3,481,867 | A | 12/1969 | Dellert | |
| 3,486,993 | A | 12/1969 | Egan et al. | |
| 3,532,618 | A | 10/1970 | Wunderlich et al. | |
| 4,022,682 | A | 5/1977 | Bludis et al. | |
| 4,022,683 | A | 5/1977 | Bludis et al. | |
| 4,548,710 | A * | 10/1985 | Simpson | 208/216 PP |
| 4,746,419 | A | 5/1988 | Peck et al. | |
| 4,950,383 | A | 8/1990 | Tait et al. | |
| 4,961,838 | A | 10/1990 | Llovera | |
| 5,779,992 | A | 7/1998 | Higashi | |
| 2003/0070808 | A1 | 4/2003 | Allison | |
| 2003/0223924 | A1 | 12/2003 | Bachtel et al. | |
| 2006/0144756 | A1* | 7/2006 | Ackerson et al. | 208/108 |
| 2007/0187294 | A1* | 8/2007 | Ancheyta Juarez et al. | 208/58 |
| 2008/0245702 | A1 | 10/2008 | Wellington et al. | |
| 2009/0107880 | A1 | 4/2009 | Chen et al. | |
| 2009/0114566 | A1 | 5/2009 | Chen et al. | |
| 2009/0188836 | A1 | 7/2009 | Bhan et al. | |
| 2009/0326289 | A1* | 12/2009 | Petri | C10G 49/26 585/263 |

FOREIGN PATENT DOCUMENTS

| | | | |
|---|---|---|---|
| CN | 1393516 | A | 1/2003 |
| CN | 101348732 | A | 1/2009 |
| EP | 0 112 667 | B1 | 3/1988 |
| GB | 1 232 173 | A | 5/1971 |
| GB | 1232173 | * | 5/1971 |
| GB | 1 276 877 | A | 6/1972 |
| JP | 09-059651 | A | 3/1997 |
| JP | 10-183143 | A | 7/1998 |
| WO | 00/42121 | A1 | 7/2000 |
| WO | 2007/149923 | A2 | 12/2007 |

OTHER PUBLICATIONS

Perry's Chemical Engineers' Handbook, Chapter 7, Reaction Kinetics (McGraw-Hill, 2008).*
PCT International Search Report and Written Opinion dated Aug. 1, 2012.
Absi-Halabi, M., et al., Coke Formation on Catalysts During the Hydroprocessing of Heavy Oils, Applied Catalysis, 1991, pp. 193-215, vol. 72, Elsevier Science Publishers B.V., Amsterdam.
Cai, H.-Y., et al., Hydrogen Solubility Measurements in Heavy Oil and Bitumen Cuts, Fuel 80, 2001, pp. 1055-1063, Elsevier.
Gallakota, S. V, et al., Diffusional Factors in the Catalytic Hydrotreating of Coal Liquids, Petroleum Resid(ua), and Heavy Crudes, AIChE 1984 Winter National Meeting, Auburn University.
Rhodes, R. P., et al., Design of Heavy Oil Upgrading (Hydrotreating) Units, AIChE 1984 Annual Meeting, San Francisco.
Riazi, M. R., et al., A Method to Predict Solubility of Hydrogen in Hydrocarbons and their Mixtures, Chemical Engineering Science, 2007, pp. 6649-6658, vol. 62, Elsevier.
Trytten, Lyle C., et al., Hydroprocessing of Narrow-Boiling Gas Oil Fractions: Dependence of Reaction Kinetics on Molecular Weight, Ind. Eng. Chem. Res., 1990, pp. 725-730, vol. 29, American Chemical Society.
Vogelaar Bas M., et al., Hydroprocessing Catalyst Deactivation in Commercial Practice, Catalysis Today, 2010, pp. 256-263, vol. 154, Elsevier.
Zingarelli, Joseph A., et al., Upgrading of Stuart Shale Oil, Short Communications, Fuel, Oct. 1988, pp. 1408-1410, vol. 67.

* cited by examiner

*Primary Examiner* — Prem C Singh
*Assistant Examiner* — Brandi M Doyle

(57) ABSTRACT

A process to treat a heavy hydrocarbon feed in a liquid-full hydroprocessing reactor is disclosed. The heavy feed has a high asphaltenes content, high viscosity, high density and high end boiling point. Hydrogen is fed in an equivalent amount of at least 160 liters of hydrogen, per liter of feed, l/l (900 scf/bbl). The feed is contacted with hydrogen and a diluent, which comprises, consists essentially of, or consists of recycle product stream. The hydroprocessed product has increased value for refineries, such as a feed for an fluid catalytic cracking (FCC) unit.

22 Claims, No Drawings

HYDROPROCESSING OF HEAVY HYDROCARBON FEEDS IN LIQUID-FULL REACTORS

FIELD OF THE INVENTION

The present invention relates to a process for hydroprocessing heavy hydrocarbon feeds in single-phase, liquid-full reactors.

BACKGROUND OF THE INVENTION

Heavy hydrocarbon mixtures contain compounds with high boiling points, and are generally characterized as having high asphaltene content, high viscosity and high density. Today, producers of heavy hydrocarbon mixtures have few options for their use, and the options available have relatively low commercial value.

Asphaltenes are present in heavy hydrocarbon mixtures and have been referred to literally as the "bottom of the barrel" in oil refining. That is asphaltenes are present in heavy hydrocarbon mixtures such as vacuum residues after higher value products, for example, naphtha (for gasoline) and diesel (for diesel fuel), are removed. The heavy hydrocarbon mixtures may further undergo solvent-deasphalting to produce a deasphalted oil (DAO), which can be used, for example, as a feed to a fluid catalytic cracking (FCC) unit.

Some heavy hydrocarbon mixtures are used as residue fuel oil (No. 6 oil), which is a low grade oil, having low value and limited use because of its high viscosity (needs to be heated before use, and cannot be used in today's vehicles) and its relatively high content of contaminants such as sulfur. Heavy hydrocarbon mixtures may be fed to coker units to produce coke. However, coker units are generally inefficient, expensive to operate and susceptible to frequent process upsets and shutdowns, often due to high aromatic content of asphaltenes. Asphaltenes may be used as solid fuels, but sulfur, nitrogen and metal content may be too high to meet quality and emission standards.

Heavy hydrocarbon mixtures may be upgraded through hydroprocessing methods such as hydrotreating and hydrocracking. Large volumes of hydrogen are required for hydroprocessing heavy hydrocarbon mixtures and very large (expensive) reactors are used. High hydrogen uptake that occurs in hydroprocessing heavy hydrocarbon mixtures results in high heat generation, which can result in rapid coking of the catalyst, and catalyst deactivation. High hydrogen input also results in tremendous hydrogen recycle, which requires a high furnace duty (large preheat furnace) and high hydrogen gas compression costs. Furthermore, heavy hydrocarbon mixtures are more likely to experience mass transfer limitations due to their high viscosity (low single pass conversion, need to recycle feed).

Hydroprocessing of mixtures containing relatively high asphaltene content is particularly difficult. Asphaltene-containing mixtures must be heated prior to use to provide a fluid that can be fed to a reactor. However, even when fluid, asphaltenes can form aggregates and clog pipes. Asphaltenes are also known to deactivate catalysts, including by mechanisms in which the asphaltenes form coke, deposits or simply precipitate on the catalyst surfaces. (See, for example, Absi-Halabi, et al., *Appl. Catal.* 72 (1991) 193-215 and Vogelaar, et al., *Catalysis Today,* 154 (2010), 256-263.) Therefore traditional options of upgrading feeds having high asphaltene content have been limited.

Still further, removal of nitrogen from asphaltenes is considered difficult. Nitrogen in asphaltenes is mainly contained in heteroaromatic rings, which require a first hydrogenation step prior to removing the nitrogen. Steric effects may further hinder nitrogen removal. (See, Trytten, et al., *Ind. Eng. Chem. Res.,* 29 (1990), 725-730.)

Thus, conventional processes for hydroprocessing heavy hydrocarbons has many disadvantages. It is usually quite expensive (large reactors, large compressors, costs for recycle of both feed and hydrogen, cost to shut down and to replace and/or regenerate deactivated catalyst). There are additional inefficiencies due to recycle of feed because of low conversions. Still further, sulfur, nitrogen, metal and aromatic content present difficulties for some systems.

A number of heavy hydrocarbon mixtures are available from refineries and other sources. Clarified slurry oil (CSO) is a heavy hydrocarbon mixture, which is the bottoms of a fluid catalytic cracking (FCC) unit. CSO represents about 6% of the FCC feed. Heavy hydrocarbon mixtures can also be derived from oil sands. A bitumen-derived heavy gas oil (HGO) can be obtained from oil sands extraction processes. Still other heavy hydrocarbon feeds may be derived from other processes for which higher value uses are desired.

Therefore, there is a need to develop a process for treating heavy hydrocarbon mixtures particularly those having relatively high asphaltene contents, which eliminates above disadvantages, inefficiencies and difficulties with known hydroprocessing processes. The present invention provides a process to upgrade heavy hydrocarbon mixtures and thus increase the value that can be derived from such mixtures.

SUMMARY OF THE INVENTION

The present invention provides a process for treating a heavy hydrocarbon feed which comprises (a) contacting the feed with (i) a diluent and (ii) hydrogen to produce a feed/diluent/hydrogen mixture, wherein the hydrogen is dissolved in the mixture to provide a liquid feed; (b) contacting the feed/diluent/hydrogen mixture with a catalyst, in a liquid-full reactor, to produce a product mixture; and (c) recycling a portion of the product mixture as a recycle product stream by combining the recycle product stream with the feed to provide at least a portion of the diluent in step (a) at a recycle ratio in a range of from about 1 to about 10; wherein the feed has an asphaltene content of at least 3%, based on the total weight of the feed; and wherein hydrogen is fed in an equivalent amount of at least 160 liters of hydrogen, per liter of feed, l/l (900 scf/bbl); and wherein the diluent, consists essentially of, or consists of recycle product stream. In the contacting step (a), the feed may be contacted with the diluent and hydrogen separately in either order, that is, (i) first with diluent to produce a feed/diluent mixture and then with hydrogen to produce a feed/diluent/hydrogen mixture or (ii) first with hydrogen to produce a feed/hydrogen mixture and then with diluent to produce a feed/diluent/hydrogen mixture. Preferably the feed is first contacted with the diluent. The process is performed in one or two or more liquid-full reactors, in which hydrogen is present in the liquid phase.

The heavy hydrocarbon feed has a viscosity of at least 5 centipoise (cP), a density of at least 900 kg/m$^3$ at a temperature of 50° C. (120° F.), and an end boiling point in the range of from about 450° C. (840° F.) to about 700° C. (1300° F.). The feed also has a bromine number, which is an indication of the aliphatic unsaturation of the feed, of at least 5, preferably at least 10.

The catalyst is a hydroprocessing catalyst comprising one or more non-precious metals selected from the group consisting of nickel, cobalt, molybdenum and tungsten and combinations of two or more thereof; and the catalyst is supported on a mono- or mixed-metal oxide, a zeolite, or a combination of two or more thereof.

DETAILED DESCRIPTION

The present invention provides a process for hydroprocessing a heavy hydrocarbon feed, which comprises (a) contacting the feed with (i) a diluent and (ii) hydrogen to produce a feed/diluent/hydrogen mixture, wherein the hydrogen is dissolved in the mixture to provide a liquid feed; (b) contacting the feed/diluent/hydrogen mixture with a catalyst, in a liquid-full reactor, to produce a product mixture; and (c) recycling a portion of the product mixture as a recycle product stream by combining the recycle product stream with the feed to provide at least a portion of the diluent in step (a) at a recycle ratio in a range of from about 1 to about 10. The diluent comprises, consists essentially of, or consists of recycled product stream. The feed has an asphaltene content of at least 3%, based on the total weight of the feed. The feed has also has a viscosity of at least 5 cP, a density of at least 900 kg/m$^3$ at a temperature of 50° C. (120° F.), and an end boiling point in the range of from about 450° C. (840° F.) to about 700° C. (1300° F.). The feed also has a bromine number of at least 5, preferably at least 10. Hydrogen is fed in the contacting step in an equivalent amount of at least 160 l/l (900 scf/bbl). Preferably hydrogen is fed in an amount equivalent to 180-530 l/l (1000-3000 scf/bbl), more preferably 360-530 l/l (2000-3000 scf/bbl).

In the present invention it has been found that hydrogen solubilities in heavy hydrocarbon mixtures in the presence of the diluent at hydroprocessing temperatures of 250-450° C. are unexpectedly high and therefore, operation of the process of the present invention, which uses liquid-full reactors with hydrogen dissolved in the liquid, is surprisingly efficient. By "high" hydrogen solubility, it is meant to have a solubility of hydrogen equal to or greater than that in a "typical" diesel mixture (i.e. 70 scf/bbl or 12.5 normal liters of hydrogen per liter of diesel at 1000 psig or 6.9 MPa and 350° C.). High hydrogen solubility is important as treating heavy hydrocarbon feeds requires high volumes of hydrogen for appreciable conversion due to high hydrogen consumption. Hydrogen is needed in treating heavy hydrocarbon feeds to for example, saturate olefins; remove sulfur, nitrogen, and metal contaminants, and for cracking.

The process of this invention operates as a liquid-full process. By "liquid-full process", it is meant herein that all of the hydrogen present in the process is dissolved in liquid. Similarly, a liquid-full reactor is a reactor in which all of the hydrogen is dissolved in the liquid phase. Thus, absent high hydrogen solubility in the liquid, a liquid-full process would be expected to be inefficient in hydroprocessing of heavy hydrocarbons.

Surprisingly, in the present invention, a reasonable and relatively small recycle ratio of 1 to 10 in a liquid-full process is able to meet the hydrogen consumption requirement for hydroprocessing a heavy hydrocarbon feed. All of the hydrogen required in the hydroprocessing reaction is available and is dissolved in the liquid diluent-feed mixture. The hydrogen-diluent-feed mixture is fed to a reactor in the process of the present invention. Hydrogen gas recirculation is avoided and trickle bed operation (in which hydrogen gas must dissolve in the liquid feed and then transport to the surface of the catalyst) is unnecessary. Smaller and simpler reactor systems replace large trickle bed systems with the attendant requirement in trickle bed systems for large hydrogen compressors to manage hydrogen recycle. Thus, the overall capital cost for hydroprocessing heavy hydrocarbon feeds is greatly reduced compared to conventional (trickle bed) hydroprocessing technology or even as may have been expected in liquid-full hydroprocessing.

Definitions

"Hydroprocessing" as used herein means any process that is carried out in the presence of hydrogen, including, but not limited to, hydrogenation, hydrotreating, hydrodesulfurization, hydrodenitrogenation, hydrodeoxygenation, hydrodemetallation, hydrodearomatization, hydroisomerization, and hydrocracking.

"FCC" as used herein means a fluid catalytic cracker, or the process of fluid catalytic cracking.

"Bitumen" as used herein refers to a mixture of organic materials that are highly viscous, and composed primarily of highly condensed polycyclic aromatic hydrocarbons. Naturally-occurring or crude bitumen is a sticky, tar-like form of petroleum which is so thick and heavy that it must be heated or diluted before it will flow. Oil sands are a source of naturally-occurring bitumen. Refined bitumen is the residual (bottom) fraction obtained by fractional distillation of crude oil.

Feeds

A heavy hydrocarbon feed is a feed that comprises one or more hydrocarbons, wherein the feed has an asphaltene content of at least 3%, based on the total weight of the feed. The asphaltenes content of heavy hydrocarbons generally varies over a range of from about 3% to about 15%, and sometimes can be as high as 25%, based on the total weight of the feed. The Conradson carbon content is in the range of from about 0.25% to about 8.0% by weight, based on the total weight of the feed. The feed has a viscosity of at least 5 cP, a density of at least 900 kg/m$^3$ at a temperature of 50° C. (120° F.), an end boiling point in the range of from about 450° C. (840° F.) to about 700° C. (1300° F.). Thus, a heavy hydrocarbon has a high boiling point, high viscosity, high density relative to lighter refinery streams such as middle distillates and vacuum gas oils. The density of heavy hydrocarbon mixtures (a composition comprising two or more heavy hydrocarbons) at standard temperature and pressure (STP, about 15.5° C. (60° F.) and 1 atmosphere (101 kPa)) typically ranges from about 900 kg/m$^3$ to about 1075 kg/m$^3$; the viscosity at STP typically ranges from about 5 cP to about 400 cP; the API gravity typically ranges from about 25 to about 0.

The boiling point for a heavy hydrocarbon feed varies over a range from about 200° C. to about 700° C. (400° F.-1300° F.), and correspondingly the end boiling point for a heavy hydrocarbon mixture is in the range of from about 450° C. (840° F.) to about 700° C. (1300° F.).

There are a variety of types and resources of heavy hydrocarbon feeds available, many from refineries, which are suitable to be upgraded by the liquid-full hydroprocessing process of the present invention.

One example of a heavy hydrocarbon feed is a clarified slurry oil (CSO), which is produced in an oil refinery as the bottoms fraction of an FCC unit. Catalyst fines are separated from the FCC bottoms fraction, typically by settling, before the CSO is used Large volumes of CSO are available from FCC units. For example, the capacity of world refinery FCC units is reportedly about 1,900,000 metric tons per day (tpd), and CSO is about 113,000 tpd, and in the United States, the capacity of FCC units is about 800,000 tpd, and CSO is about 49,000 tpd (see, "Fluid Catalytic Cracking and Light Olefins Production Plus Latest Refining Technology Developments and Licensing", Hydrocarbon Publishing Company, Southeastern, Pa. 19399 (2009)).

Despite large volumes of CSO available, CSO is typically used as a blend in a low grade product such as No. 6 oil. Use of CSO is limited by sulfur and nitrogen content that may be detrimental to particular uses. For example, for use as a feed to an FCC unit, nitrogen content must be less than 1700 parts per million (ppm) to avoid deactivation of the FCC catalyst. Surprisingly, the process of this invention can be used to treat CSO to produce a product with higher value to a refinery, including use as a feed for FCC units, as the treated product can have a nitrogen content of less than 1700 ppm.

In addition to CSO, other heavy hydrocarbon feeds include coker product, coal liquefied oil, product from heavy oil thermal cracking process, product from heavy oil hydrotreating and/or hydrocracking, straight run cut from a crude oil unit, and mixtures of two or more thereof. Such heavy hydrocarbons are known to those skilled in the art.

The heavy hydrocarbon feeds may also include bitumen, including bitumen extracted from oil sands. Oil sands are large deposits of naturally occurring mixtures of bitumen, water, sand, clays, and other inorganic materials found on the earth's surface. Bitumen is extracted from the oil sands and separated from the other components followed by refining. The largest oil sands deposits are found in Canada and Venezuela.

Catalyst

A catalyst is used in the hydroprocessing process of this invention to catalyze reaction of hydrogen with the heavy hydrocarbon feed to provide one or more of reduction in unsaturation (both olefinic and aromatic carbon-carbon double bonds), removal or reduction of sulfur, nitrogen, oxygen, metals or other contaminations in the feed and cracking (reduction of molecular weight).

The catalysts used in the process of this invention comprise a metal and an oxide support. The metal is a non-precious metal selected from the group consisting of nickel and cobalt, and combinations thereof. Nickel and/or cobalt is typically combined with molybdenum or tungsten or a combination thereof. Preferably the metal is a combination of metals selected from the group consisting of nickel-molybdenum (NiMo), cobalt-molybdenum (CoMo), nickel-tungsten (NiW) and cobalt-tungsten (CoW).

The metals are supported on an oxide support. The oxide is a mono- or mixed-metal oxide, or a combination of two or more thereof. The oxide can be selected from the group consisting of alumina, silica, titania, zirconia, kieselguhr, silica-alumina and combinations of two or more thereof. For purposes of this invention, silica-alumina includes zeolites. Particularly useful catalysts in the process of this invention are cobalt-molybdenum supported on γ-alumina ($CoMo/Al_2O_3$) and nickel-molybdenum supported on γ-alumina ($NiMo/Al_2O_3$).

The catalyst may further comprise other materials including carbon, such as activated charcoal, graphite, and fibril nanotube carbon, as well as calcium carbonate, calcium silicate and barium sulfate.

Optionally, a promoter may be used with the active metal in the process of the present invention. Suitable metal promoters include: (1) Groups I and II metals (alkali metals and alkaline earth metals, particularly, lithium, sodium, potassium); (2) tin, copper, gold, silver, and combinations thereof; and (3) Group VIII metals (Fe, Ru, Os, Co, Rh, Ir, Ni, Pd, Pt). The catalysts may also be promoted with fluorine, boron, and/or phosphorus. The catalyst is activated by simultaneous reduction and sulfiding before subjecting it to hydrotreating reactions.

The catalyst can be prepared using any of a variety of ways known in the art. Preferably, a preformed (e.g., already calcined) metal oxide is used. For example, the metal oxide is preferably calcined before application of the active metal. The method of placing the active metal on the first oxide is not critical. Several methods are known in the art. Many suitable catalysts are available commercially.

Preferably, the catalyst is in the form of particles, more preferably shaped particles. By "shaped particle" it is meant the catalyst is in the form of an extrudate. Extrudates include cylinders, pellets and spheres. Cylinder shapes may have hollow interiors with one or more reinforcing ribs. Trilobe, cloverleaf, rectangular and triangular shaped tubes, cross and "C" shaped catalysts can be used. Preferably the shaped catalyst particle is about 0.25 to about 13 mm (about 0.01 to about 0.5 inch) in diameter when a packed bed reactor is used. More preferably, the catalyst particle is about 0.79 to about 6.4 mm (about 1/32 to about 1/4 inch) in diameter.

The catalyst may be sulfided before and/or during use by contacting the catalyst with a sulfur-containing compound at an elevated temperature. Suitable sulfur-containing compounds include thiols, sulfides, disulfides, $H_2S$, or combinations of two or more thereof. The catalyst can be sulfided before it is used ("pre-sulfiding") or during the hydrotreating process ("sulfiding") by introducing a small amount of a sulfur-containing compound into the heavy hydrocarbon feed or diluent. The catalyst may be pre-sulfided in situ or ex situ and the feed or diluent may be supplemented periodically with added sulfur-containing compound to maintain the catalyst in a sulfided condition. Pre-sulfiding is particularly advantageous when the catalyst comprises molybdenum. The Examples provide a pre-sulfiding procedure.

Process

The hydroprocessing process of the present invention for hydroprocessing a heavy hydrocarbon feed comprises (a) contacting a feed having an asphaltene content of at least 3%, based on the total weight of the feed, with (i) a diluent and (ii) hydrogen to produce a feed/diluent/hydrogen mixture, wherein the hydrogen is dissolved in the mixture to provide a liquid feed; (b) contacting the feed/diluent/hydrogen mixture with a catalyst, in a liquid-full reactor, to produce a product mixture; and (c) recycling a portion of the product mixture as a recycle product stream to provide at least a portion of the diluent in step (a). In step (c), the recycle product stream is combined with the feed at a recycle ratio in a range of from about 1 to about 10, preferably 1 to 5. The feed has a viscosity of at least 5 cP, a density of at least 900 $kg/m^3$ at a temperature of 50° C., an end boiling point of at least from about 450° C. (840° F.) to about 700° C. (1300° F.). The catalyst comprises nickel and/or cobalt, preferably combined with molybdenum or tungsten, and a metal oxide support. Hydrogen is fed in an equivalent amount of at least 160 l/l (900 scf/bbl).

In the process of the present invention, a feed is contacted with a diluent and hydrogen. The feed can be contacted first with hydrogen and then with the diluent or preferably, first with the diluent and then with hydrogen to produce a feed/diluent/hydrogen mixture. The feed/diluent/hydrogen mixture is contacted with a catalyst to produce a product mixture. The diluent comprises, consists essentially of, or consists of recycle product stream. Recycle product stream is a portion of the product mixture that is recycled and combined with the hydrocarbon feed before or after contacting the feed with hydrogen, preferably before contacting the feed with hydrogen at a recycle ratio of from about 1 to about 10. The recycle product stream provides at least a portion of the diluent at a recycle ratio in a range of from about 1 to about 10, preferably at a recycle ratio of from about 1 to about 5.

In addition to recycle product stream, the diluent may comprise any other organic liquid that is compatible with the heavy hydrocarbon feed. When the diluent comprises an organic liquid in addition to the recycled product stream, preferably the organic liquid is a liquid in which hydrogen has a relatively high solubility. The diluent may comprise an organic liquid selected from the group consisting of light hydrocarbons, light distillates, naphtha, diesel and combinations of two or more thereof. More particularly, the organic liquid is selected from the group consisting of propane, butane, pentane, hexane or combinations thereof. When the diluent comprises an organic liquid, the organic liquid is typically present in an amount of no greater than 90%, based on the total weight of the feed and diluent, preferably 1-80%, and more preferably 10-80%. Most preferably, the diluent consists of recycled product stream, including the dissolved C3-C6 light hydrocarbons.

The present invention provides a process for hydroprocessing a heavy hydrocarbon feed in which hydrogen is mixed and/or flashed together with the feed to provide hydrogen in solution.

The feed may be contacted with hydrogen to form a feed/hydrogen mixture in advance of contacting the feed/hydrogen mixture with the diluent to produce a feed/diluent/hydrogen mixture. The diluent is preferably contacted with the feed prior to contacting the feed with hydrogen. In this preferred process, the feed/diluent mixture is then contacted with hydrogen to form a feed/diluent/hydrogen mixture. The feed/diluent/hydrogen mixture is then contacted with the catalyst.

The catalyst is held in a reactor which, under operating conditions, is a liquid-full reactor. By "liquid-full reactor" is meant the reactor is substantially free of a gas phase. The reactor is a two phase system wherein the catalyst is a solid phase and the reactants (feed, hydrogen, diluent) and products (processed feed, hydrogen and diluent) are all in the liquid phase. The reactor is a fixed bed reactor and may be of a plug flow, tubular or other design, which is packed with a solid catalyst (i.e., a packed bed reactor) and wherein the liquid feed/diluent/hydrogen mixture is passed through the catalyst. In the presence of the catalyst and diluent, the feed reacts with hydrogen to produce a product mixture. Useful catalysts are described hereinabove.

It should be understood that the packed bed reactor may be a single packed bed or two or more (multiple) beds. Two or more beds may be in series or in parallel or a combination thereof. Fresh hydrogen can be added into the liquid feed/diluent/hydrogen mixture at the inlet of each reactor, to permit the added hydrogen to dissolve in the mixture.

The hydroprocessing process of this invention comprises contacting the liquid feed/diluent/hydrogen mixture with catalyst in a liquid-full reactor at elevated temperature and pressures to hydroprocess feeds into product mixtures. Temperatures range from about 250° C. to about 450° C., preferably at 300° C. to 400° C., most preferably at 325° C. to 375° C. Pressures range from 500 to 2500 psig (3.45 to 17.25 MPa), preferably 1000 to 2000 psig (6.9 to 13.9 MPa). A wide range of suitable catalyst concentrations may be used. Preferably, the catalyst is 10 to 50 wt % of the reactor contents. Hydrocarbon feed LHSV typically, ranges from 0.1 to 10 $hr^{-1}$, preferably, 0.5 to 10 $hr^{-1}$, more preferably 0.5 to 5.0 $hr^{-1}$.

Surprisingly, the process of the present invention eliminates or minimizes catalyst coking which is one of the biggest problems with conventional hydroprocessing of heavy hydrocarbon feeds. Since high hydrogen uptake in hydrotreating heavy feeds (e.g., 160-535 l/l, 900-3000 scf/bbl) results in high heat generation in the reactor, severe cracking is expected to take place on the surface of the catalyst. If the amount of hydrogen available to the catalyst is not sufficient, coke formation may occur, leading to catalyst deactivation. The process of the present invention makes available in the liquid feed/diluent/hydrogen mixture, all of the hydrogen required for reaction, thus eliminating the need to circulate hydrogen gas within the reactor. Although hydrogen solubility has been an issue for hydroprocessing of heavy hydrocarbons, because there is enough hydrogen available in solution, coking of the catalyst is largely avoided. Furthermore, the liquid-full reactors of the present invention dissipate heat much better than conventional trickle bed reactors. Thus, catalyst life is prolonged.

Hydrogen solubility in heavy hydrocarbon feeds is unexpectedly "high", frequently higher than 18 l/l (100 scf/bbl) of oil at operating temperatures and pressures, sometimes as high as 36 l/l (200 scf/bbl) of oil or more. This is surprising and because it was expected that hydrogen solubility in heavy hydrocarbons mixtures was much lower. With low solubility, hydroprocessing a heavy hydrocarbon mixture was expected to result in relatively low conversion, even at high recycle ratios (e.g., higher than 10:1), thus making liquid-full reactors less competitive (more expensive to operate) than conventional trickle bed reactors. (See, Cai, et al. *Fuel,* 80 (2001), 1055-1063; and Riazi and Roomi, *Chem. Eng. Sci.* 62 (2007), 6649-6658.)

It was expected the consumption required to treat, heavy hydrocarbons would require use of very high recycle ratios of greater than 10 in a liquid-full reactor, which would make hydroprocessing in a liquid-full reactor uncompetitive due to low conversion per pass through the reactor.

The present invention provides a reasonable and relatively small recycle ratio of 1-10, preferably 1-5, which is surprisingly able to meet the hydrogen consumption requirement to produce the desired product. That is, since sufficient hydrogen is available in the hydrogen-diluent-feed mixture, which is fed to the liquid-full reactor in the process of the present invention, no additional hydrogen gas is required and expensive gas recirculation unit operations are avoided. Hence, by using the process of this invention, large trickle bed reactors can be replaced by much smaller and simpler reactors such as a plug flow, tubular or other reactors.

Advantageously, the process of the present invention also eliminates or minimizes the need to have a high furnace duty such as a large preheat furnace which is required in a conventional hydroprocessing process based on trickle bed reactors with hydrogen gas circulation. In the present invention, for example, heat and unused hydrogen is carried in the recycle product stream whereas in conventional processes unused hydrogen separates from the product and a compressor is used to bring hydrogen pressure to operating pressure.

Most reactions in hydroprocessing are highly exothermic and as a result, a great deal of heat is generated in the reactor. In the present invention, a certain volume of reactor effluent—product mixture—is recycled back to the front of the reactor as recycle product stream and blended with fresh feed and hydrogen. The recycle product stream absorbs some of the heat generated in the reactor. Thus, the temperature of the feed-diluent-hydrogen mixture and the reactor temperature can be controlled by controlling the fresh feed temperature and the amount of recycle.

Product

The product mixture of hydroprocessed heavy hydrocarbon feed in the present invention has reduced viscosity, density, sulfur and nitrogen contents, Conradson carbon, and asphaltenes content, with an increased cetane index.

The viscosity of the product mixture of the present invention is typically reduced from about 10-50 cP to about 1-5 cP. The product mixture has a density of from about 900 to about 1075 kg/m$^3$, and has a API gravity of from about 25 to about 0. The asphaltenes content of the product mixture is reduced from 1-10% to about 0.1-1%. The product mixture has a Conradson carbon (MCR) of from about 0.1% to about 3%. The product mixture has a boiling point range from about 150° C. to about 600° C. (about 300° F. to about 1100° F.). The contents of sulfur and nitrogen compounds in hydrocarbon feeds are significantly reduced through the hydroprocessing process of the present invention.

The product mixture can be further processed, such as for example, in a residue cracking unit, such as a FCC unit, after removing the lighter fractions (naphtha and diesel). The removed lighter product mixtures of naphtha or diesel may be blended into gasoline, diesel or other value-adding streams in a petroleum refinery.

EXAMPLES

Analytical Methods and Terms

"LHSV" means liquid hourly space velocity, which is the volumetric rate of the liquid feed divided by the volume of the catalyst, and is given in hr$^{-1}$.

"WABT" means weighted average bed temperature.

Amounts of sulfur, nitrogen, basic nitrogen, metals (aluminum, iron, nickel, silicon, vanadium) are provided in parts per million by weight, wppm.

$^{13}$C aromaticity, was determined by NMR spectroscopy.

"Ash, filtered" means determination of the ash content of a liquid material. Ash, filtered was determined by filtering and collecting solids, which were then burned and weighed.

ASTM Standards. All ASTM Standards are available from ASTM International, West Conshohocken, Pa., www.astm.org.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

API gravity is determined using ASTM Standard D4052 (2005), "Standard Test Method for Density, Relative Density and API Gravity of Liquids by Digital Density Meter," ASTM International, West Conshohocken, Pa., 2003, DOI: 10.1520/04052-09.

"Asphaltenes content" refers to the content of asphaltenes in a feed. Asphaltenes are highly polar and high molecular weight compounds that are found in crude oil. Asphaltene content is determined as a percent of a hydrocarbon mixture that is heptane insoluble and was determined using ASTM Standard D6560, 2000 (2005), "Standard Test Method for Determination of Asphaltenes (Heptane Insolubles) in Crude Petroleum and Petroleum Products," DOI: 10.1520/06560-00R05.

Aniline Point provides an estimate of the aromatic hydrocarbon content of mixtures of hydrocarbons. Aniline was determined using ASTM Standard D611, 2007, "Standard Test Methods for Aniline Point and Mixed Aniline Point of Petroleum Products and Hydrocarbon Solvents," DOI: 10.1520/00611-07.

Basic nitrogen was determined using ASTM Standard D2896 (2007a "Standard Test Method for Base Number of Petroleum Products by Potentiometric Perchloric Acid Titration," DOI: 10.1520/D2896-07A.

"Conradson carbon" is also referred to as percent micro carbon residue or % MCR, and is a measure of the carbon residue value of petroleum materials, which serves as an indication of the material to form carbonaceous deposits. For purposes herein, Conradson carbon and MCR are used interchangeably. Conradson carbon or MCR is determined using ASTM Standard D4530, 2007, "Standard Test Method for Determination of Carbon Residue (Micro Method)," DOI: 10.1520/D4530-07.

Bromine Number is a measure of aliphatic unsaturation in petroleum samples. Bromine Number was determined using ASTM Standard D1159, 2007, "Standard Test Method for Bromine Numbers of Petroleum Distillates and Commercial Aliphatic Olefins by Electrometric Titration," DOI: 10.1520/D1159-07.

Refractive Index (R1) was determined using ASTM Standard D1218 (2007), "Standard Test Method for Refractive Index and Refractive Dispersion of Hydrocarbon Liquids," DOI: 10.1520/D1218-02R07.

Cetane Index is useful to estimate cetane number (measure of combustion quality of a diesel fuel) when a test engine is not available or if sample size is too small to determine this property directly. Cetane Index was determined by ASTM Standard D4737 (2009a), "Standard Test Method for Calculated Cetane Index by Four Variable Equation," DOI: 10.1520/D4737-09a.

Boiling point distribution (data, Table 6) was determined using ASTM Standard D7169 (2005), "Standard Test Method for Boiling Point Distribution of Samples with Residues Such as Crude Oils and Atmospheric and Vacuum Residues by High Temperature Gas Chromatography", DOI: 10.1520/D7169-05.

Boiling range distribution (data, Table 9) was determined using ASTM D2887 (2008), "Standard Test Method for Boiling Range Distribution of Petroleum Fractions by Gas Chromatography," DOI: 10.1520/D2887-08.

The following examples are presented to illustrate specific embodiments of the present invention and not to be considered in any way as limiting the scope of the invention.

Example 1. Heavy Gas Oil (HGO) from Oil Sands

A heavy gas oil (HGO) was prepared by aqueous extraction of an oil sands ore containing bitumen. Several extraction fractions were collected to provide the heavy gas oil having the properties provided in Table 1.

TABLE 1

Properties of the Heavy Gas Oil used in Examples 1 through 13

| Property | Unit | Value |
|---|---|---|
| Asphaltene content | wt % | >4 |
| Sulfur | wppm | 41700 |
| Total Nitrogen | wppm | 3474 |
| Basic Nitrogen | wppm | 1120 |
| Aluminum | wppm | 0.97 |
| Iron | wppm | 0.28 |
| Nickel | wppm | ND |
| Vanadium | wppm | 1.67 |
| Density at 20° C. | g/mL | 0.9929 |
| Density at 15° C. (60 F.) | g/mL | 0.9958 |
| $^{13}C$ aromaticity | % | 39.4 |
| MCR (Conradson carbon) | wt % | 1.9 |
| Aniline Point | ° C. | 95 |
| Bromine Number | g $Br_2$/100 g | 17.1 |

The HGO was hydroprocessed in an experimental pilot unit containing a set of three fixed bed reactors in series. Each fixed bed reactor was of 19 mm (¾") OD 316L stainless steel tubing and about 50 cm (19") in length with reducers to 6 mm (¼") on each end. Both ends of the reactors were first capped with metal mesh to prevent catalyst leakage. Below the metal mesh, the reactors were packed with layers of 1 mm glass beads at both ends. Catalyst was packed into the middle of the tubing.

The first reactor (Reactor #1) contained a guard bed catalyst to saturate olefins and remove metals (such as Ni, V, Si). The guard bed catalyst was Ni—Mo on γ —$Al_2O_3$ catalyst from Criterion Catalysts & Technologies, Houston, Tex. (RN-410). This catalyst was followed by a hydrotreating catalyst also of Ni—Mo on γ —$Al_2O_3$ support in the same Reactor #1 (Criterion Catalyst DN-200). Both catalysts were extrudites of about 1.3 mm diameter and 10 mm long. A layer of ~1.2 cm deep of 1 mm diameter glass beads separated the guard bed catalyst from the hydrotreating catalyst in Reactor #1. The ratio of the volume of guard bed catalyst to the volume of hydrotreating catalyst contained in all three reactors was 5.

Reactor #2 and Reactor #3 were packed with layers of 1 mm glass beads at both ends, 44 ml at the top and 10 ml at the bottom, and contained only the hydrotreating catalyst (Criterion Catalyst DN-200).

Each reactor was placed in a temperature controlled sand bath having 7.6 cm (3") OD and 120 cm long pipe filled with fine sand. Temperatures were monitored at the inlet and outlet of each reactor as well as in each sand bath. The temperature was controlled using heat tape, which was connected to temperature controllers. Heat tape was wrapped around the sand bath containing the heating and reaction sections of the reactor. The pipe was wrapped by two separate heat tapes to maintain desired temperatures in the inlet and the outlet of the reactors. After exiting Reactor #3 (the last reactor), the product mixture was split into a recycle product stream and product. The recycle product stream flowed through an Eldex triple head piston metering pump, which discharged the stream to combine with fresh hydrocarbon feed. The recycle product stream served as diluent in this Example.

Hydrogen was fed from compressed gas cylinders and the flow was measured using mass flow controllers. Hydrogen was injected via an in-line tee fitting prior to Reactor #1. The hydrogen was mixed with the HGO feed and the recycle product stream. HGO feed/hydrogen/recycle product stream mixture flowed downwardly through a first temperature-controlled sand bath and then in an up-flow mode through Reactor #1. After exiting Reactor #1, additional hydrogen was added to and dissolved in the product of Reactor #1 (the feed to Reactor #2), and the feed to Reactor #2 with dissolved hydrogen flowed downwardly through a second temperature-controlled sand bath and then in an up-flow mode through Reactor #2. After exiting Reactor #2, more hydrogen was added to and dissolved in the product of Reactor #2 (the feed to Reactor #3), and the feed to Reactor #3 with dissolved hydrogen flowed downwardly through a third temperature-controlled sand bath and then in an up-flow mode through Reactor #3.

Both the guard catalyst (18 mL) and the hydrotreating catalyst (total 90 mL) were dried overnight at 130° C. under a flow of 200 standard cubic centimeters per minute (sccm) of nitrogen. The dried catalysts were charged to the reactors as described above. The catalyst-charged reactors were heated to 230° C. with a flow charcoal lighter fluid through the catalyst beds. A sulfur spiking agent (1 wt % sulfur, added as 1-dodecanethiol) and hydrogen gas were introduced into the charcoal lighter fluid at 230° C. (450° F.) to pre-sulfide the catalysts. The pressure was 6.9 MPa (1000 psig or 69 bar). The temperature of the reactors was increased gradually to 320° C. (610° F.). Pre-sulfiding was continued at 320° C. until breakthrough of hydrogen sulfide ($H_2S$) was observed at the outlet of Reactor #3. After pre-sulfiding, the catalyst was stabilized by flowing a straight run diesel (SRD) feed through the catalysts in the reactors at a temperature varying from 320° C. (610° F.) to 355° C. (670° F.) and at pressure of 6.9° MPa (1000 psig or 69 bar) for approximately 8 hours.

After pre-sulfiding and stabilizing the catalyst with SRD at a diesel hydrotreating pressure range (6.9 MPa), the heavy gas oil (HGO) feed mixture was pre-heated to 50° C., and was pumped to Reactor #1 using a syringe pump at flow rate of 2.25 mL/minute. The total hydrogen feed rate was 180 l/l (1000 scf/bbl) of fresh hydrocarbon feed. The temperature of the reactors (WABT) was 387° C. (728° F.), and the pressure was about 10.8 MPa (1560 psig, 109 barg). The recycle ratio was 4.25. The reactors were run under the above conditions for three days to assure that the catalyst was fully precoked and the system was lined-out with the heavy feed while testing for both total sulfur and total nitrogen.

A Total Liquid Product (TLP) sample and an off-gas sample were collected under the steady state conditions. The sulfur, the nitrogen, and overall material balances were measured by using a GC-FID. From the total hydrogen feed and hydrogen in the off-gas, the hydrogen consumption ($H_2$ cons.) was calculated to be 161 l/l (904 scf/bbl).

Such a high rate of hydrogen consumption is not experienced in hydroprocessing of lighter hydrocarbon mixtures such as diesel or jet fuel where a typical hydrogen consumption may be in the range of 35 to 55 liter/liter (200 to 300 scf/bbl). Such high rates of hydrogen consumption involving high heat generation may also result in localized temperature spikes on catalyst surface in traditional trickle bed reactors, eventually leading to coke formation. This example, therefore, demonstrates that the liquid-full hydroprocessing reactors could be successfully used for injecting high rates of hydrogen into heavy hydrocarbon mixtures to upgrade them sufficiently so that they may be fed to an FCC unit in an oil refinery.

The sulfur and nitrogen contents of the TLP sample collected during the test were found to be 2856 ppm, and 1327 ppm, respectively. The TLP sample with a nitrogen content of 1327 ppm was within desired nitrogen specification of 1400 ppm and thus the product mixture was suitable for use as feed to an FCC unit where it would not poison the zeolite-based cracking catalyst.

The TLP sample collected during this experiment was batch distilled to take a naphtha cut (Initial Boiling Point, IBP, of 177° C.) and a diesel cut (177° C. to 343° C.) to obtain the product yield distributions provided in Table 2.

TABLE 2

Product distribution for TLP of Example 1

| Compound/Fraction | Weight % | Volume % |
|---|---|---|
| $H_2S$ | 4.2 | |
| $NH_3$ | 0.3 | |
| $C_1$ | 0.4 | |
| $C_2$ | 0.4 | |
| $C_3$ | 0.4 | |
| $C_{4+}$ | 0.9 | |
| Naphtha $C_5$/177° C. (350° F.) | 2.2 | 2.7 |
| Diesel 177-343° C. (350-650° F.) | 16.1 | 18.0 |
| Heavy fraction 343° C.+ (650° F.+) | 76.4 | 80.1 |
| Total ($C_{5+}$ for vol %) | 101.3 | 100.8 |

The first column in Table 2 shows the amount of $H_2S$, $NH_3$, light hydrocarbons (HCs), naphtha, diesel and the heavy HCs in terms of weight percent of the fresh feed. The total is greater than 100% due to $H_2$ injection to the feed. The second column expresses only the liquid products of naphtha, diesel and heavy fraction (343° C.+) in terms of volume percentage of the feed. Again the total yield of liquid product is greater than 100% (even with not counting all the gases) because the density of the feed is reduced via $H_2$ gas injection (volume swell). This is beneficial to the refiner because the transportation fuels are sold by volume.

Each liquid cut was analyzed for density, sulfur and nitrogen content, and for several other important fuel properties. The results are provided in Table 3.

TABLE 3

Product Properties for Example 1

| Cut Range | Naphtha $C_5$/ 177° C. | Diesel 177° C./ 343° C. | Heavy Fraction 343° C.+ | TLP Sample |
|---|---|---|---|---|
| Asphaltenes, wt % | <0.1 | <0.1 | <0.4 | <0.3 |
| Sulfur, wppm | 23 | 317 | 3065 | 2856 |

TABLE 3-continued

Product Properties for Example 1

| Cut Range | Naphtha $C_5$/ 177° C. | Diesel 177° C./ 343° C. | Heavy Fraction 343° C.+ | TLP Sample |
|---|---|---|---|---|
| Nitrogen, wppm | 35 | 282 | 1599 | 1327 |
| MCR, wt % | | | 0.17 | |
| Ni, ppm | | | <1 | |
| V, ppm | | | <2 | |
| API Gravity | 43.3 | 28.3 | 18.6 | 21.3 |
| Aniline Point, ° C. | | 32 | 69 | 62 |
| Cetane Index | | 33 | | |

The results for this Example shows the heavy fraction (343° C.+) of the hydroprocessed composite sample (TLP) had less than 1700 ppm of nitrogen. Thus, the sulfur content in the heavy fraction was reduced by more than 93%, the asphaltene and the Conradson Carbon (MCR) contents were reduced by more than an order of magnitude as compared to the feed. The heavy fraction (343° C.+) of the TLP, therefore, seems to be suitable for use as a feedstock to an FCC unit in an oil refinery without poisoning the FCC catalyst. The diesel fraction may be sold as heating oil or may be blended into an ultra-low sulfur diesel (ULSD) pool after further treatment to reduce its sulfur content. This example then demonstrates that a low quality heavy HC mixture such as CSO may be upgraded by deep-hydrotreating in a liquid-full reactor.

Examples 2-13

Example 1 was repeated under varying process conditions in Examples 2-13. Twelve additional data points were collected, and the results are provided in Table 4. In Examples 1 through 3 the $H_2$ feed was 180 l/l (1000 scf/bbl) while in Examples 4 through 13 the $H_2$ feed was 150 l/l (850 scf/bbl).

TABLE 4

Summary of Examples 1 through 13

| Example Number | LHSV $hr^{-1}$ | WABT ° C. | Density$^{60° F.}$ g/mL | Sulfur wppm | Nitrogen wppm | % S Convers. | % N Convers. | Asphaltenes wt % | $H_2$ Cons. l/l (scf/bbl) |
|---|---|---|---|---|---|---|---|---|---|
| Feed | N/A | N/A | 0.9958 | 41696 | 3474 | N/A | N/A | >3.0 | N/A |
| 1 | 1.5 | 387 | 0.9269 | 2856 | 1327 | 93.2 | 61.8 | <0.3 | 161 (904) |
| 2 | 1.5 | 387 | 0.9237 | 2559 | 1282 | 93.9 | 63.1 | <0.3 | 163 (914) |
| 3 | 1.5 | 387 | 0.9270 | 3017 | 1340 | 90.4 | 58.6 | <0.3 | 161 (905) |
| 4 | 1.5 | 387 | 0.9319 | 4680 | 1976 | 92.8 | 61.4 | <0.3 | 147 (823) |
| 5 | 2.0 | 387 | 0.9334 | 4431 | 1779 | 89.2 | 49.5 | <0.3 | N/A |
| 6 | 2.0 | 387 | 0.9340 | 4502 | 1755 | 88.8 | 43.1 | <0.3 | 143 (805) |
| 7 | 2.0 | 377 | 0.9370 | 5280 | 1827 | 87.3 | 47.9 | <0.3 | 140 (789) |
| 8 | 2.0 | 377 | 0.9379 | 5299 | 1811 | 89.4 | 48.8 | <0.3 | 138 (776) |
| 9 | 2.0 | 366 | 0.9409 | 6768 | 1913 | 83.1 | 43.2 | <0.3 | 139 (783) |
| 10 | 2.0 | 366 | 0.9420 | 7051 | 1972 | 87.3 | 47.4 | <0.3 | 134 (753) |
| 11 | 2.0 | 355 | 0.9457 | 8997 | 2088 | 79.6 | 41.7 | <0.3 | 126 (707) |
| 12 | 2.0 | 355 | 0.9453 | 8502 | 2024 | 79.4 | 39.8 | <0.3 | 131 (736) |
| 13 | 2.0 | 355 | 0.9462 | 8573 | 2093 | 83.8 | 44.9 | <0.3 | 126 (707) |

Results for Examples 1, 2 and 3 show less than 1400 ppm of nitrogen can be achieved in the combined total liquid product (TLP) using the hydroprocessing process of this invention. Having a TLP with a total nitrogen content of less than 1400 ppm in the TLP is important to meet the desired specification of 1700 ppm (by weight) of maximum nitrogen in the 343° C.+ fraction. Therefore, the product samples shown in Table 4 are suitable to be used as feed into an FCC unit at a refinery, without poisoning zeolite-based FCC catalysts. Examples 4 through 13 were conducted to obtain kinetic information for the process.

The high hydrogen consumption illustrated in Examples 1 through 13 demonstrate the ability of liquid-full hydroprocessing reactors to be able to handle such high levels of heat generation experienced while upgrading the low-grade heavy hydrocarbon feeds without compromising the life and activity of the solid hydroprocessing catalyst due to coke formation.

Note that the asphaltenes content in Examples 1 through 13 was reduced by more than an order of magnitude (from above 3% in the feed to below 0.3% in the product). This again shows the ability of the liquid-full hydrotreating reactors to easily upgrade such heavy hydrocarbon mixtures with high asphaltenes content to more valuable feedstocks.

Example 14. Clarified Slurry Oil (CSO) from a Refinery Fluid Catalytic Cracking (FCC) Unit A clarified slurry oil (CSO) from an FCC Unit of a petroleum refinery was hydroprocessed in the pilot unit described in Example 1, with certain modifications to the unit. The properties of this feed are provided in Tables 5 and 6.

TABLE 5

Properties of the Clarified Slurry Oil Sample

| Property | Unit | Measured | Target |
|---|---|---|---|
| Sulfur | wppm | 13600 | 5800 |
| Total Nitrogen | wppm | 3125 | 1700 |
| Basic Nitrogen | wppm | 138 | |
| Ash, filtered | wt % | 0.008 | 0.003 |
| API Gravity | g/mL | 2.1 | 22.2 |
| Specific Gravity | g/mL | 1.0592 | 0.9208 |
| Density at 15.6° C. | g/mL | 1.0582 | 0.9199 |
| Density at 50° C. | g/mL | 1.0390 | |
| Refractive Index | | 1.5748 | |
| Carbon Type | | | |
| Saturates | wt % | 18.5 | |
| Aromatics | wt % | 46.2 | |
| Polars | wt % | 23.5 | |
| Asphaltenes | wt % | 11.8 | |
| MCR | wt % | 4.96 | |

TABLE 6

Boiling Point Distribution of CSO Feed Sample

| Simulated distillation, wt % | Boiling Point ° C. (° F.) |
|---|---|
| Initial Boiling Point (IBP) | 204 (399) |
| 1% | 237 (459) |
| 3% | 293 (560) |
| 5% | 324 (616) |
| 10% | 359 (678) |
| 20% | 393 (740) |
| 30% | 410 (771) |
| 40% | 423 (793) |
| 50% | 434 (813) |
| 60% | 446 (835) |
| 70% | 461 (862) |
| 80% | 480 (896) |
| 90% | 516 (961) |
| 99% | 571 (1060) |
| End Point (EP) | 613 (1135) |

Tables 5 and 6 show that the CSO feed mixture is extremely heavy and low value, having an asphaltene content of 12%, a Micro-Carbon Residue (or Conradson Carbon) of 5%, a density of 1058 kg/m$^3$ at 15.5° C. (60° F.) and a final boiling point of 613° C. (1135° F.). It has a total sulfur content of 1.4 wt % and a total nitrogen content of more than 0.3 wt %. The goal is to hydrotreat this feed mixture to determine whether it would be feasible to upgrade it enough to be able to feed it to an FCC unit in a petroleum refinery. The "Target" column provides the values the corresponding properties should have for the product to be an acceptable feed to an FCC unit. These values could be achieved via reduction in density, sulfur, nitrogen, asphaltenes, and MCR contents, accompanied by a high hydrogen uptake.

Only two reactors were used in this experiment (Example 14), The reactors were packed with a hydrotreating catalyst as described in Example 1. No guard bed catalyst was used. That is, only Reactors #2 and #3 were used. Each of Reactor #2 and Reactor #3 contained 60 mL of a commercial Ni—Mo on γ —$Al_2O_3$ catalyst (TK-561) available from Haldor Topsøe, Lyngby, Denmark. The process of Example 1 was repeated.

Catalysts were dried and pre-sulfided as described in Example 1. The feed was then changed to SRD to stabilize the catalyst as described in Example 1 at a temperature varying from 320° C. (610° F.) to 355° C. (670° F.) and at pressure of 6.9 MPa (1000 psig or 69 bar) for one day as a an initial pre-coking step. The feed was then switched to CSO in order to complete the pre-coking of the catalyst by feeding CSO for at least 8 hr and testing for sulfur until the system was lined-out. The process of Example 1 was repeated using CSO as the feed to produce a product mixture having reduced viscosity, density, sulfur and nitrogen content, carbon residue and asphaltenes content.

More specifically, the CSO feed was pre-heated to 50° C. and pumped to the pilot unit using a syringe pump at flow rate of 1.50 ml/minute, to achieve a LHSV of 0.75 hr$^{-1}$ based on the total catalyst volume. The total hydrogen feed rate was 320 l/l (1800 scf/bbl). Temperature of the reactors (WABT) was 343° C. (650° F.) and the pressure was 138 bar (2015 psia, 14 MPa). The recycle ratio was 8.2. The unit was run for 12 hours to achieve steady state.

A Total Liquid Product (TLP) sample and an off-gas sample were collected under the steady state conditions. Results are provided in Table 7. Sulfur, nitrogen, and overall material balances were measured by using a GC-FID. Hydrogen consumption was calculated from the hydrogen feed and hydrogen in the off-gas, to be approximately 210 l/l (1200 scf/bbl). Sulfur and nitrogen contents of the sample were found to be ~3900 ppm, and 800 ppm, respectively. The density (at 60° F. or 15.5° C.) of the feed at was reduced from 1058 kg/m$^3$ to 1001 kg/m$^3$ in the product mixture. Both the reduction of sulfur and nitrogen were found to be at excellent levels for the product from this deep hydrotreating process to be fed to an FCC unit. Specifically the nitrogen was much lower than 1700 ppm level considered to be the limit for the FCC catalyst. The sulfur level was reduced from about 13,600 ppm to below 4000 ppm, below the target level of 5800 ppm. Again the sample was reduced in asphaltenes content from about 12 wt % to that below 1 wt %. The above results again demonstrate the ability of the liquid-full hydroprocessing reactors to upgrade such heavy and low value HC mixtures to highly valuable streams to be further treated and blended into final fuel products in an oil refinery.

Examples 15-20

Example 14 was repeated under varying process conditions in Examples 15-20. The recycle ratio was 8.2 for Examples 14-20. Six additional data points were collected at different operating conditions to test the quality of the hydrotreated product. The experimental conditions and the results for Examples 14 through 20 are provided in Table 7.

TABLE 7

Summary of Examples 14 through 20

| Example Number | LHSV $hr^{-1}$ | WABT ° C. | Density$^{60° F.}$ g/cc | API Gravity | Sulfur wppm | Nitrogen wppm | Asphaltenes wt % | $H_2$ Cons. N l/l (scf/bbl) |
|---|---|---|---|---|---|---|---|---|
| Feed | | | 1.0582 | 2 | 13600 | 3125 | 12 | |
| 14 | 0.75 | 343 | 1.0012 | 10 | 3904 | 804 | <1 | 209 (1171) |
| 15 | 0.75 | 357 | 0.9966 | 10 | 2630 | 678 | <1 | 225 (1264) |
| 16 | 0.76 | 371 | 0.9869 | 12 | 1266 | 505 | <1 | 260 (1458) |
| 17 | 1.50 | 371 | 1.0008 | 10 | 2450 | 865 | <1 | 206 (1156) |
| 18 | 1.50 | 357 | 1.0102 | 8 | 4372 | 1179 | <1 | 169 (947) |
| 19 | 0.50 | 371 | 0.9817 | 13 | 973 | 475 | <1 | 244 (1373) |
| 20 | 0.50 | 385 | 0.9799 | 13 | 538 | 437 | <1 | 234 (1315) |

As can be seen in Table 7, hydrogen consumption was extremely high, in some examples exceeding 250 normal liters of $H_2$ per liter of oil, N l/l (1400 scf/bbl), which is surprisingly high compared to consumption rates usually observed in ULSD applications which range 35 to 55 N l/l (200 to 300 scf/bbl). At more severe conditions, higher WABT or lower LHSV, the density reduction and the higher conversion of sulfur and nitrogen (Examples 15, 16 19 and 20) show that the hydrotreated products of CSO are potentially acceptable to be blended in an FCC feed for further upgrading. Again the asphaltenes content of the feed was reduced by more than an order of magnitude and the density was reduced by as much as 8%.

The results summarized on Table 7 thus show that a CSO stream may be successfully deep-hydrotreated in a liquid-full reactor to reduce its sulfur, nitrogen, and asphaltenes content, to reduce its density after a substantial $H_2$ uptake. It is surprising such a high $H_2$ uptake in this hydrotreating process occurred while substantially maintaining temperature control with no catalyst coking problems as has been previously encountered in trickle bed operations.

Example 21. Hydrocarbon Feed Derived from Oil Shale (Shale Oil)

A heavy hydrocarbon feed was obtained from oil shale by thermal cracking and simple distillation of oil shale. The feed has the properties disclosed in Tables 8 and 9.

TABLE 8

Properties of the Shale Oil Sample

| Property | Unit | Value |
|---|---|---|
| Asphaltenes content | wt % | 4.1 |
| Sulfur | ppm, by weight | 7300 |
| Total Nitrogen | ppm, by weight | 1200 |
| Oxygen | wt. % | 6.97 |
| Metals | | |
| Silicon | ppm, by weight | <10 |
| Nickel | ppm, by weight | <1 |
| Vanadium | ppm, by weight | <1 |
| MCR | wt % | 3.5 |
| Density at 50° C. | g/ml | 0.9367 |
| Density at 20° C. | g/ml | 0.9600 |
| Bromine Number | g $Br_2$/100 g | 91.6 |
| Refractive Index @ 20° C. | | 1.590 |

TABLE 9

Boiling Range Distribution of Shale Oil

| Fraction, wt % | Boiling Point (° C.) |
|---|---|
| IBP | 116 |
| 5% | 158 |
| 10% | 195 |
| 20% | 236 |
| 30% | 264 |
| 40% | 283 |
| 50% | 304 |
| 60% | 324 |
| 70% | 347 |
| 80% | 372 |
| 90% | 408 |
| 95% | 432 |
| 99% | 459 |
| EP | 466 |

The process of Example 1 was repeated using three reactors. Reactor #1 contained guard bed catalyst, KF-647, and Reactors #2 and #3 contained hydroprocessing catalyst, KF-860, both of which are Ni—Mo supported on γ—$Al_2O_3$, from Albemarle Corp., Baton Rouge, La. All other steps were the same. The catalysts were dried, sulfided and stabilized with SRD, as previously described in Examples 1 and 14.

The feed was first passed through Reactor #1 as a pretreatment to remove/reduce heavy metals and oxygen content (hydrodeoxygenation) and to saturate olefinic double bonds. The pretreated sample was then hydroprocessed in a continuous fashion in fixed bed Reactors #2 and #3 as described in Example 1.

Specifically, the shale oil feed was preheated to 50° C., and pumped to Reactor #1 at a flow rate of 2 mL/minute to achieve a LHSV of 3.0 $hr^{-1}$ based on the total catalyst volume. Total hydrogen feed rate was 250 l/l (1400 scf/bbl). The temperature of the reactors was 316° C. (600° F.), and the pressure was 93 bar (1350 psia, 9.3 MPa). The recycle ratio was 5.

Results are provided in Table 10. The product mixture had significantly lower viscosity, a reduced density of 886 kg/$m^3$ at 20° C., sulfur content of 1169 ppm and nitrogen content of 1000 ppm as shown in Table 8. Total hydrogen consumption was estimated at 230 l/l (1300 scf/bbl). The asphaltenes content was reduced again by more than an order a magnitude (from above 4% to below 0.3%). The oxygen content was also reduced from about 7 wt % to below detection (<0.1%). The hydrotreated sample was much thinner (less viscous) than the feed. The feed was so viscous that it required to be heated to 50° C. in order to pump it to the process. The experiment has shown that the highly-viscous shale oil sample was successfully hydrotreated to a product that could be used as a blending feedstock for a #2 heating oil or a diesel fuel.

Examples 22-27

Example 21 was repeated under different process conditions. Six additional data points were collected. Example conditions and results are provided in Table 10. All Examples 21-27 were run at a space velocity (LHSV) of 3.0 $hr^{-1}$ and at a recycle ratio of 5.0.

TABLE 10

Summary of Examples 21 through 27

| Example Number | WABT ° C. | $H_2$ Feed N l/l (scf/bbl) | Density$^{20\ C.}$ g/cc | Asphaltenes wt % | RI at 20° C. | Sulfur ppm | Nitrogen ppm |
|---|---|---|---|---|---|---|---|
| Feed | | | 0.9600 | 4.1 | 1.5900 | 7300 | 1200 |
| 21 | 340 | 210 (1200) | 0.8864 | <0.3 | 1.4927 | 1200 | 1000 |
| 22 | 360 | 210 (1200) | 0.8823 | <0.3 | 1.4916 | 900 | 966 |
| 23 | 370 | 210 (1200) | 0.8747 | <0.3 | 1.4906 | 500 | 915 |
| 24 | 370 | 270 (1500) | 0.8666 | <0.3 | 1.4856 | 250 | 634 |
| 25 | 360 | 270 (1500) | 0.8591 | <0.3 | 1.4833 | 160 | 540 |
| 26 | 370 | 270 (1500) | 0.8610 | <0.3 | 1.4837 | 90 | 420 |
| 27 | 385 | 270 (1500) | 0.8597 | <0.3 | 1.4852 | 60 | N/A |

As shown in Table 10, as the severity of the hydroprocessing was increased by increasing the reactor temperature, the sulfur and the nitrogen contents of the product were also decreased. In Example 23, the hydrogen consumption was getting close to the hydrogen feed, hence the hydrogen feed rate was increased from 214 l/l (1200 scf/bbl) to 267 l/l (1500 scf/bbl) which helped reduce the sulfur content in the product from 500 ppm to 250 ppm. In Example 27, the sulfur content was reduced to 60 ppm from 7300 ppm in the feed. The nitrogen content of the product sample from Example 27 was not measured ("N/A"). The asphaltenes content of all the samples in Examples 21 through 27 were again reduced by more than an order of magnitude.

The same catalyst was used throughout the series of Examples. Activity was maintained—that is no deactivation occurred—after all the above experiments.

These Examples than showed that a heavy hydrocarbon mixture derived from oil shale may be successfully treated in a liquid-full hydrotreating reactor to upgrade it so that it could be used as a blending stock for a fuel.

Comparative Example. Light Cycle Oil (LCO) from a Refinery Fluid Catalytic Cracking Unit A Light Cycle Oil (LCO) sample from an FCC Unit of a petroleum refinery, with the properties disclosed in Table 11, was, hydroprocessed in the pilot unit described in Example 1, with certain modifications to the unit.

TABLE 11

Properties of the Light Cycle Oil Feed and Product Samples

| Property | Unit | Feed | Product |
|---|---|---|---|
| Asphaltene content | wt % | <0.1 | <0.1 |
| Sulfur | wppm | 2350 | 35 |
| Total Nitrogen | wppm | 835 | 3 |
| Aromatics | | | |
| Mono- | wt % | 21.6 | 28.2 |
| Poly- | wt % | 38.6 | 6.4 |
| Total | wt % | 60.2 | 34.6 |
| MCR | wt. % | <0.1 | <0.1 |
| API Gravity | | 18.2 | 25.7 |

TABLE 11-continued

Properties of the Light Cycle Oil Feed and Product Samples

| Property | Unit | Feed | Product |
|---|---|---|---|
| Specific Gravity | | 0.9455 | 0.9004 |
| Density at 15.6° C. | g/ml | 0.9446 | 0.8995 |
| Bromine No. | g/100 g | 8.6 | <1.0 |
| Refractive Index | | 1.5407 | 1.4910 |

Only two reactor beds were used for this Example. The reactors were packed with a hydrotreating catalyst as described in Example 1. No guard bed catalyst was used. That is, only Reactors #2 and #3 were used. Each of Reactor #2 and Reactor #3 contained 60 mL of a commercial Ni—Mo on $\gamma$ —$Al_2O_3$ catalyst (TK-607) available from Haldor Topsøe, Lyngby, Denmark. The process of Example 1 was repeated for loading the catalysts and pressure testing the pilot unit.

Catalyst was again dried, sulfided as described in Example 1. The pilot unit was also treated with SRD as described in Example 1 at a temperature varying from 320° C. (610° F.) to 355° C. (670° F.) and at pressure of 6.9 MPa (1000 psig or 69 bar) for one day for stabilizing the catalyst and as an initial precoking step. The feed was then switched to LCO. The process of Example 1 was repeated using LCO as the feed to produce a product mixture having reduced viscosity, density, sulfur, nitrogen, residue, and asphaltenes content.

More specifically, the LCO feed was pumped to the pilot unit using a syringe pump at flow rate of 4.0 ml/minute, to achieve a LHSV of 2.0 $hr^{-1}$ based on the total catalyst volume. The total hydrogen consumption was 250 l/l (1400 scf/bbl). Temperature of the reactors (WABT) was 371° C. (700° F.), and the pressure was 138 bar (2000 psia, 13.8 MPa). The recycle ratio was 6.0. The unit was run for 12 hours to achieve steady state. A Total Liquid Product (TLP) sample and an off-gas sample were collected under the steady state conditions. Sulfur, nitrogen, and overall material balances were measured by, using a GC-FID. Hydrogen consumption was calculated from the hydrogen feed and hydrogen in the off-gas, to be approximately 225 l/l (1265 scf/bbl). Sulfur and nitrogen contents of the sample were found to be 35 ppm, and 3 ppm, respectively. The density (at 60° F. or 15.5° C.) of the feed at was reduced from 945 $kg/m^3$ to 900 $kg/m^3$ in the product.

It was surprising to find out that our more difficult heavy HC feeds used in Examples 1 through 27 above were as easily upgraded to more valuable HC mixtures by hydrotreating them in liquid-full reactors as the much easier-to-treat feed of an LCO shown in Comparative Example A above.

What is claimed is:

1. A process to treat a heavy hydrocarbon feed comprising:

(a) contacting the feed with (i) a diluent and (ii) hydrogen to produce a feed/diluent/hydrogen mixture, wherein the hydrogen is dissolved in the mixture to provide a liquid feed;

(b) contacting the feed/diluent/hydrogen mixture with a catalyst, in a liquid-full fixed bed reactor of plug flow or tubular design, to produce a product mixture; and (c) recycling a portion of the product mixture as a recycle product stream by combining the recycle product stream with the feed to provide at least a portion of the diluent in step (a) at a recycle ratio in a range of from about 1 to about 10;

wherein the feed has an asphaltene content of at least 3%, based on the total weight of the feed; wherein hydrogen is fed in an equivalent amount of at least 160 l/l (900 scf/bbl); wherein the diluent comprises, consists essentially of, or consists of recycled product stream; and wherein the asphaltene content of the product mixture is reduced by more than an order of magnitude as compared to the feed.

2. The process of claim 1 wherein hydrogen is fed in an equivalent amount of 180-530l/l (1000-3000 scf/bbl).

3. The process of claim 2 wherein hydrogen is fed in an equivalent amount of 360-530l/l (2000-3000 scf/bbl).

4. The process of claim 1 wherein the feed is first contacted with the diluent to produce a feed/diluent mixture and then the feed/diluent mixture is contacted with hydrogen to provide the feed/diluent/hydrogen mixture.

5. The process of claim 1 wherein the heavy hydrocarbon feed has a viscosity of at least 5 cP, a density of at least 900 $kg/m^3$ at a temperature of 50° C. (120° F.), an end boiling point in the range of from about 450° C. (840° F.) to about 700° C. (1300° F.), and a Conradson carbon content in the range of from about 0.25% to about 8.0% by weight.

6. The process of claim 1 wherein the heavy hydrocarbon feed is selected from the group consisting of clarified slurry oil, bitumen, coker product, coal liquefied oil, product from heavy oil thermal cracking process, product from heavy oil hydrotreating and/or hydrocracking, straight run cut from a crude oil unit, and mixtures of two or more thereof.

7. The process of claim 5 wherein the heavy hydrocarbon feed is bitumen extracted from oil sands.

8. The process of claim 1 wherein the catalyst is a hydroprocessing catalyst comprising a metal selected from the group consisting of nickel and cobalt, and combinations thereof, and the catalyst is supported on a mono- or mixed-metal oxide, a zeolite, or a combination of two or more thereof.

9. The process of claim 8 wherein the metal is a combination of metals selected from the group consisting of nickel-molybdenum (NiMo), cobalt-molybdenum (CoMo), nickel-tungsten (NiW) and cobalt-tungsten (CoW).

10. The process of claim 9 wherein the mono- or mixed-metal oxide is alumina, silica, titania, zirconia, kieselguhr, silica-alumina or a combination of two or more thereof.

11. The process of claim 1 further comprising, prior to step (a), sulfiding the catalyst by contacting the catalyst with a sulfur-containing compound at an elevated temperature.

12. The process of claim 1 wherein the recycle ratio is 1 to 5.

13. The process of claim 1 wherein the diluent consists or consists essentially of the recycle product stream.

14. The process of claim 1 wherein the diluent comprises an organic liquid selected from the group consisting of light hydrocarbons, light distillates, naphtha, diesel and combinations of two or more thereof.

15. The process of claim 1 wherein the fixed bed reactor is a single packed bed reactor.

16. The process of claim 1 wherein the fixed bed reactor is two or more (multiple) packed beds in series or in parallel or in a combination thereof.

17. The process of claim 16 wherein fresh hydrogen is added at the inlet of each reactor bed.

18. The process of claim 1 wherein temperature ranges from about 250° C. to about 450° C.; pressure ranges from 3.45 to 17.25 MPa (500 to 2500 psig), and hydrocarbon feed (LHSV) ranges from 0.1 to 10 $hr^{-1}$.

19. The process of claim 18 wherein temperature ranges from about 300° C. to 400° C.; pressure ranges from 6.9 to 13.9 MPa (1000 to 2000 psig).

20. The process of claim 1 wherein the asphaltene content of the product mixture is about 0.1-1%.

21. The process of claim 1 wherein the product mixture has a viscosity of about 1-5 cP, a density of from about 900 to about 1075 $kg/m^3$, a API gravity of from about 25 to about 0, a boiling point range from about 150° C. to about 600° C., and a Conradson carbon (MCR) of from about 0.1% to about 3%.

22. The process of claim 1 wherein the catalyst is a hydroprocessing catalyst comprising one or more non-precious metals.

* * * * *